US005376834A

United States Patent [19]

Carobolante

[11] Patent Number: 5,376,834

[45] Date of Patent: Dec. 27, 1994

[54] INITIALIZATION CIRCUIT FOR AUTOMATICALLY ESTABLISHING AN OUTPUT TO ZERO OR DESIRED REFERENCE POTENTIAL

[75] Inventor: Francesco Carobolante, San Jose, Calif.

[73] Assignee: SGS-Thomson Microelectronics, Inc., Carrollton, Tex.

[21] Appl. No.: 26,986

[22] Filed: Mar. 5, 1993

[51] Int. Cl.[5] ..... G05F 1/00

[52] U.S. Cl. ..... 327/143; 377/56; 327/198; 327/307; 327/341; 327/156; 327/538

[58] Field of Search ..... 307/491, 493, 494, 495, 307/359, 264, 529, 553, 562, 296.6, 272.3; 328/135, 147, 154, 159, 162, 168, 169, 172, 173, 175; 377/56

[56] References Cited

U.S. PATENT DOCUMENTS

| | | | |
|---|---|---|---|
| 3,857,104 | 12/1974 | Sacks | 328/159 |
| 4,140,874 | 2/1974 | Thomas | 328/162 |
| 4,621,204 | 11/1986 | Loessel et al. | 307/494 |
| 4,707,624 | 11/1987 | Yee | 307/494 |

*Primary Examiner*—Timothy P. Callahan
*Assistant Examiner*—Shawn Riley
*Attorney, Agent, or Firm*—Richard A. Bachand; Rodney M. Anderson; Lisa K. Jorgenson

[57] ABSTRACT

A circuit for initializing the output voltage of an analog circuit includes a switch operative to connect an input of the analog circuit to a first reference potential during an initializing period. A comparator is connected to compare the output voltage of the analog circuit with a second reference potential to produce an output representing the comparison. A resistor ladder having a plurality of voltage step output lines along its length is connected to inputs of a multiplexer, the multiplexer having an output connected to bias the analog circuit. A counter having a clock input and a count output is connected with the count output connected to operate the multiplexer to sequentially select among the steps of the resistor ladder. A circuit clocks the counter until the output of the comparator reaches a predetermined value, wherein a voltage step output line of the resistor ladder is selected to control the output of the multiplexer.

20 Claims, 2 Drawing Sheets

INITIALIZATION CIRCUIT FOR AUTOMATICALLY ESTABLISHING AN OUTPUT TO ZERO OR DESIRED REFERENCE POTENTIAL

BACKGROUND OF THE INVENTION

1. Field of the Invention

This invention relates to improvements in electrical circuitry for automatically establishing a reference output value of an analog circuit, particularly in phase locked loop circuits, or the like.

2. Relevant Background

In the operation of many circuits, circuit offsets are oftentimes compensated in quiescent circuit states to minimize their effects on the output signal. One way that this can be done, for example, is to measure the output of the circuit under quiescent conditions and adjust the circuit bias to achieve a desired output voltage, usually, but not necessarily, zero.

This initialization is many times a critical requirement for phase locked loop circuits that employ linear components. In such circuits, it is important to reduce the circuit offsets as much as possible, since such offsets are integrated by analog integrator circuit portions of the phase locked loop, thereby introducing steady state phase errors.

When circuit components are permanently adjusted to compensate for circuit offsets, oftentimes component aging and variations in circuit operating voltages change the output error compensation, deleteriously affecting the operation of the circuit. What is needed is a circuit that automatically adjusts the output of a circuit, such as a phase locked loop circuit or the like, that automatically initializes the circuit to a quiescent value, such as zero or other value, and that can operate automatically in response to a condition, such as a power-on event, or the like.

SUMMARY OF THE INVENTION

In light of the above, it is, therefore, an object of the invention to provide a circuit for initializing the output voltage of an analog circuit.

It is another object of the invention to provide an initializing circuit of the type described that automatically establishes the output of the analog circuit to a pre-defined value.

It is yet another object of the invention to provide an initialization circuit of the type described that can be operated automatically upon the occurrence of a power-on event.

It is still another object of the invention to provide an initialization circuit of the type described that can be used in conjunction with digital phase locked loop circuits, or the like.

These and other objects, features, and advantages will become apparent to those skilled in the art from the following detailed description when read in conjunction with the accompanying drawings and appended claims.

In accordance with a broad aspect of the invention, a circuit for initializing the output voltage of an analog circuit is presented. The circuit includes a switch that is operative to connect an input of the analog circuit to a first reference potential during an initialization period. A comparator is connected to compare the output voltage of the analog circuit with a second reference potential. The comparator produces an output representing the comparison. A resistor ladder having a plurality of voltage step output lines along its length is connected to the input terminals of a multiplexer. The output of the multiplexer is connected to bias the analog circuit in accordance with the voltage selected along the resistor ladder. A counter having a clock input and count output is connected with the count output connected to the multiplexer to operate it to sequentially select among the steps of the resistor ladder depending upon the count. A circuit is provided to clock the counter until the output of the comparator reaches a predetermined value. The predetermined value controls the selection of the voltage step output line from the resistor ladder to control the output of the multiplexer.

In one embodiment of the invention, the initializing circuit is used to initialize an integrator circuit that has an operational amplifier with feedback elements connected between its input and output. In this embodiment, a switch is provided that is operative during an initialization period to disconnect the feedback elements. The output from the multiplexer is used as the reference voltage to the integrator circuit, and the output from the integrator circuit is used to determine the selection of the voltage step output lines of the resistor ladder.

In still another embodiment, the initialization circuit is used to initialize the analog portion of a phase locked loop. In this embodiment, a summing amplifier is provided between digital input nodes and an integrating filter. The input nodes are connected to a reference potential during an initialization period and the output from the multiplexer is used as the bias reference potential of the summing amplifier.

In still another broad aspect of the invention, a method is provided for initializing an output of an analog circuit to a desired level. In accordance with the method, a first reference voltage is applied to an input of the analog circuit. A difference signal is produced between an output of the analog circuit and a second reference potential. A bias reference potential on the analog circuit is increased from an initial bias reference potential until the difference signal equals the desired level. At that point, the input of the analog circuit is switched to a normal input mode and the increased bias reference potential is maintained on the analog circuit.

BRIEF DESCRIPTION OF THE DRAWINGS

The invention is illustrated in the accompanying drawings in which.

In the various figures of the drawing, like reference numerals are used to denote like or similar parts.

DETAILED DESCRIPTION OF THE PREFERRED EMBODIMENTS

Figure 1:
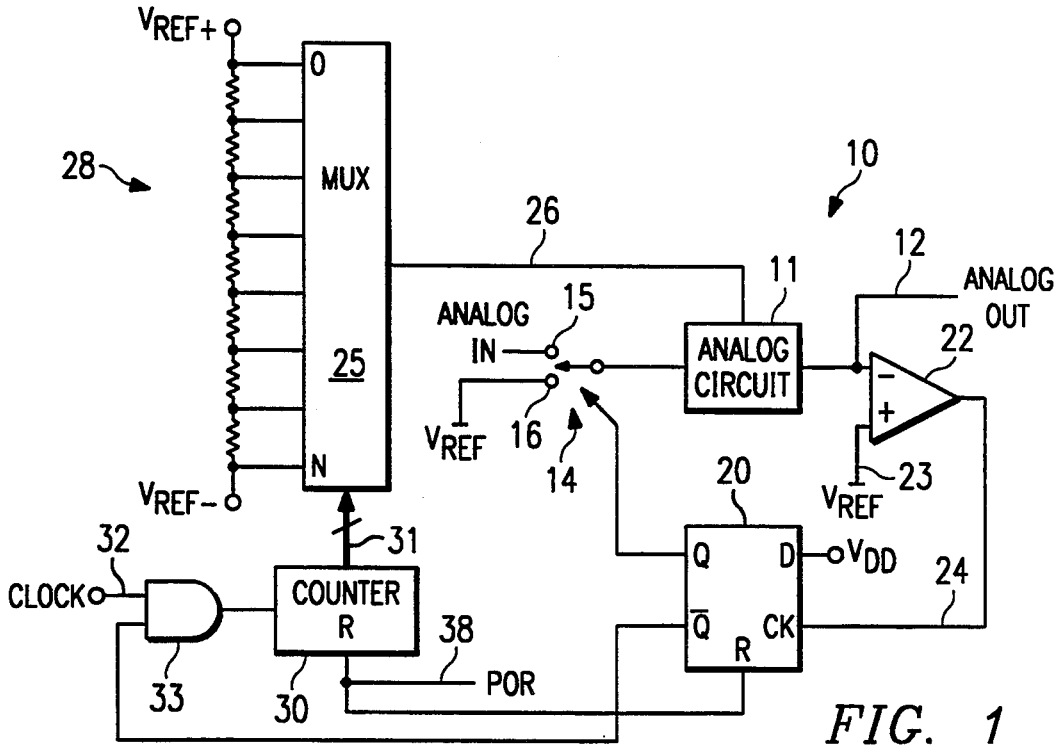
FIG. 1 is an electrical schematic diagram showing a preferred embodiment of the initialization circuit of the invention used in conjunction with a generalized analog circuit.

An initialization circuit 10, in accordance with a preferred embodiment of the invention, is shown in FIG. 1, for the purpose of initializing the voltage output from the analog circuit 11 on an analog output line 12. A switch 14 is connected to the input of the analog circuit 11 to selectively connect the input either to the analog input signal normally supplied on a line 15 or a reference voltage on a terminal 16. The position or state of the switch 14 is controlled by the Q output of a D-type flip-flop 20, below described in detail. It will be understood that the function of the switch 14 can be served by a transistor switch, or the like, such transistor switches being well known in the art. It will therefore be appreciated that the low state of the Q output of the D-type flip-flop 20 causes the switch 14 to connect the reference voltage, $V_{ref}$, to the input of the analog circuit 11, and a high state of the Q output of the D-type flip-flop 20 causes the switch 14 to connect the analog input signal on the input line 15 to the input of the analog circuit 11.

In addition to the connection of the output of the analog signal 11 to the analog output line 12, the output from the analog circuit 11 is also connected to the non-inverting input of a comparator 22. The inverting terminal of the comparator 22 is connected to a second reference voltage on line 23. The second reference voltage can be the same as the reference voltage applied to node 16 of the switch 14, and may be, if desired, a "zero" logic state, or, if desired, the reference voltages can be different in order to achieve a desired constant offset voltage realized by the output signal of the analog circuit 11. The comparator is therefore connected to compare the output voltage of the analog circuit with the second reference potential to produce an output representing the comparison on output line 24.

The internal bias reference voltages supplied to the analog circuit 11 that influence the offset voltage or base level of the output voltage on line 12 therefrom is derived from the output of a multiplexer 25 on a line 26. The input to the multiplexer 25 is derived from a plurality of voltage step lines that are generated by a resistor ladder 28 connected between positive and negative reference voltages as shown. It will be appreciated that although a resistor ladder network 28 is shown, other voltage step sources can be equally advantageously employed. One of the advantages, however, of the resistor ladder network illustrated is that if the circuit 10 were to be used in conjunction with a digital-to-analog converter, such resistor ladder network circuits often already exist in many digital-to-analog converters, thereby, reducing the hardware requirements needed to realize the circuit 10. As indicated, the voltage step output lines from the resistor ladder network 28 are connected to the inputs O-N of the multiplexer 25.

The multiplexer 25 is controlled by the digital count on the output lines from a counter 30 on address bus 31. The counter 30 is clocked by clock pulses on input line 32 via an AND gate 33. The Q(bar) output from the D-type flip-flop 20 is connected to the other input of the AND gate 33. Finally, the counter 30 and the D-type flip-flop 20 are reset by an initializing signal, such as a signal generated in response to a power-on event, that may be applied on a line 38.

The operation of the circuit 10 will be appreciated to begin, for example, with initial power being applied. Immediately, a power-on reset signal is generated by circuitry (not shown) and delivered to the circuit 10 on the line 38 to reset both the counter 30 and the D-type flip-flop 20. The Q output of the D-type flip-flop 20 assumes a logic "zero" state, causing the switch 14 to switch to the node 16 on which a reference signal exists. As mentioned, the reference signal can be a zero value, or other value that is to be used to derive a particular value output from the analog circuit 11.

The counter is clocked by clock pulses on the line 32 to begin an upward count, the count of which being applied on the bus 31 to the multiplexer 25. The clock pulses are enabled to pass the AND gate 33, because the Q(bar) output of the D-type flip-flop 20 is in a logic "high" state. As the count of the counter 30 increases, the multiplexer in response thereto steps up along the voltage step output lines from the resistor ladder 28, each successive step appearing on the output line 26 to thereby modify the bias reference voltage applied to the analog circuit 11. As the bias reference voltage of the analog circuit 11 is modified, the output on line 12 to the comparator 22 changes.

At the point at which the output voltage from the analog circuit 11 on line 12 exceeds the reference voltage on line 23, the comparator 22 changes states, to thereby clock the D-type-flip-flop 20. The Q(bar) output then changes state to a logic low level to thereby inhibit the passage of further clock pulses to the counter 30. Additionally, the Q output goes high to switch the switch 14 to the normal analog in line 15. The combination of the multiplexer 25, counter 30, and D-type flip-flop 20, serve as a memory to continue the application of the selected voltage at the output of the multiplexer 25 as applied to the analog circuit 11.

Figure 2:
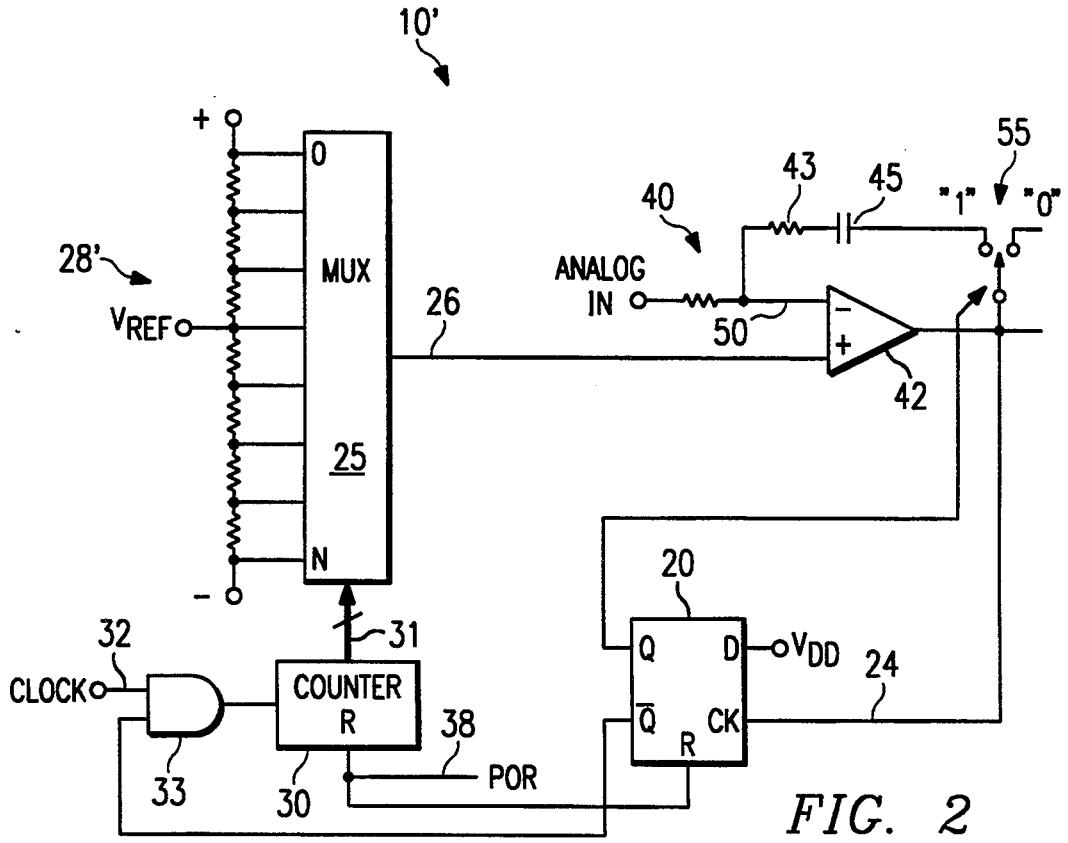
FIG. 2 is an electrical schematic diagram of an initialization circuit in accordance with another preferred embodiment of the invention used in conjunction with an integrator filter circuit.

The initialization circuit can be used, for example, in conjunction with various other circuitry. Thus, as shown in FIG. 2, a circuit 10' is shown used in conjunction with an integrating filter 40. The initialization circuit shown in FIG. 2 is similar to that described above with reference to FIG. 1, and includes a multiplexer 25, counter 30, D-type flip-flop 20, AND gate 33 for controlling the passage of input to clock pulses on line 32 to the counter 30. The output of the multiplexer 30, however, is connected to a non-inverting input of the integrator filter 40.

The integrator filter circuit 40 includes an operational amplifier 42 that has a resistor 43 and capacitor 45 connected in series between the output on line 24 and the inverting input on line 50. A switch 55 is connected in the series path containing the resistor 43 and capacitor 45 and is operative to disconnect the series connection between the input and output during the initialization of the circuit. Thus, the Q output of the D-type flip-flop is connected to the switch 55 so that on initial operation, the feedback path is disconnected.

The output of the multiplexer circuit 25 is connected to the non-inverting input of the operational amplifier 42.

In order that the output from the operational amplifier 42 may swing above and below the analog ground, the resistor ladder network 28' is referenced in a center portion to another reference voltage corresponding to the potential of the analog ground of the circuit.

The operation of the circuit 10' is similar to that described above in that initially the counter 30 and D-type flip-flop 20 are reset. As the counter 30 begins its count of clock pulses applied via gate 33, the voltage step output lines from the resistor ladder network 28' are sequentially applied to the output of the multiplexer 25. When the voltage of the reference supplied at the output from the multiplexer 25 exceeds the voltage applied to the inverting input of the operational amplifier 42 from preceding stages in, for example, quiescence states, the output from the operational amplifier 42 changes states, clocking the D-type flip-flop 20, thereby discontinuing application of clock pulses to the counter 30, thereby memorizing the voltage that produced the state change of the operational amplifier 42.

Figure 3:
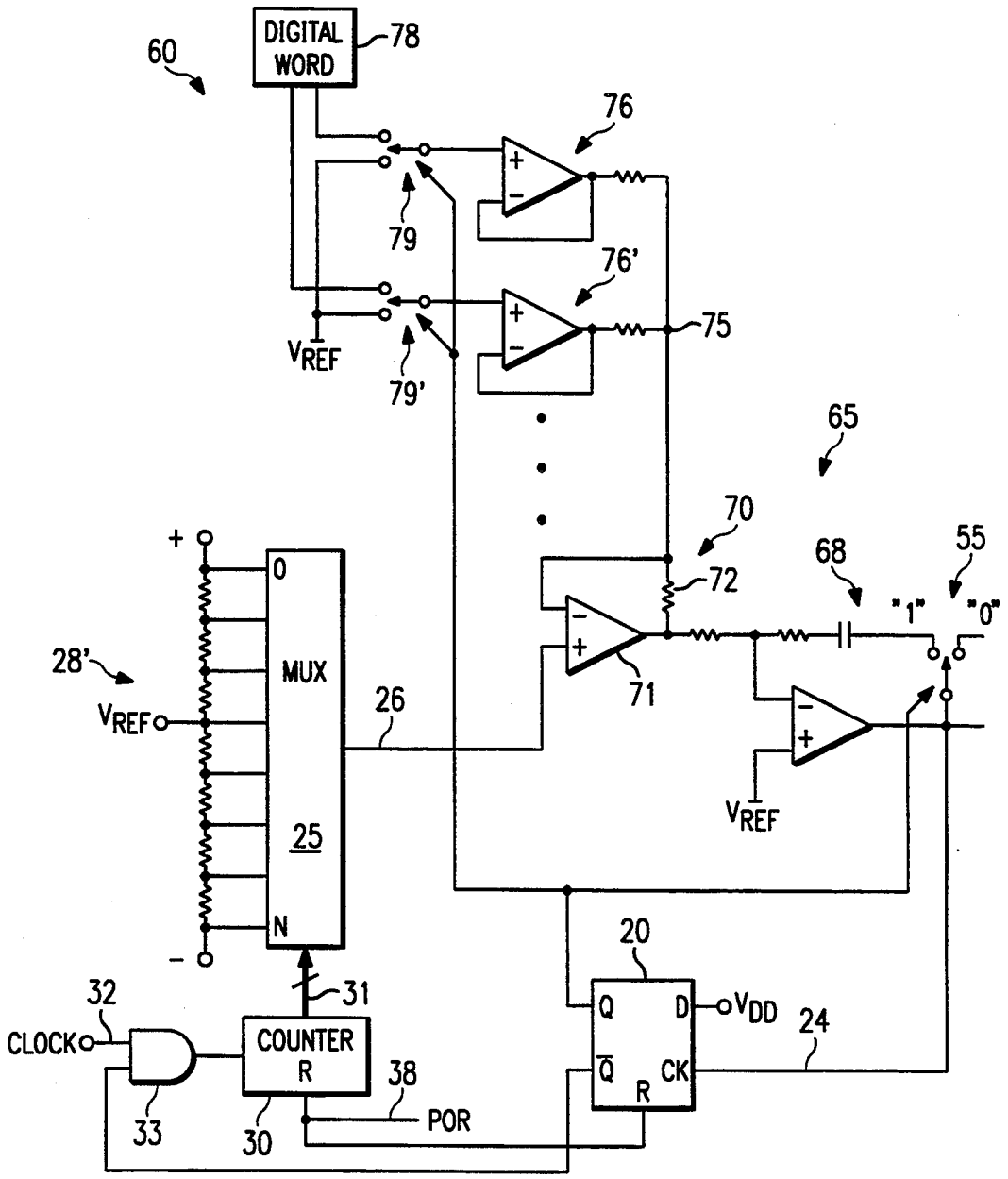
FIG. 3 is an electrical schematic diagram of yet another preferred embodiment of the initialization circuit of the invention used in conjunction with a digital phase locked loop circuit.

With reference now to FIG. 3, the initializing circuit embodiment 60 in accordance with the invention is shown in controlling tile initial output of a digital phase locked loop circuit 65. The phase locked loop circuitry 65 includes a phase locked loop integrator filter 68 that is connected in the manner described above with reference to FIG. 2, except that the non-inverting input is connected to a reference potential, $V_{ref}$. The inverting input of the operational amplifier of the phase locked loop integrator filter 68 is derived from a summing amplifier 70. The summing amplifier 70 includes an operational amplifier 71 and a resistor 72 that is connected between the output of the operational amplifier 71 and its inverting input. The output from the multiplexer circuit 25 is connected to the non-inverting input of the operational amplifier 71 of the summing amplifier 70.

The input to the summing amplifier 70 is derived on a node 75 that receives the outputs from a plurality of operational amplifier circuits 76, 76', . . . . The inputs to each of the operational amplifiers 76, 76', . . . are received from a circuit 78 providing the digital word to be converted.

In order that the circuit 65 be initialized, in addition to the switch 55 at the output of the phase locked loop integrator filter 68, a plurality of switches 79, 79', . . . are provided between the digital circuitry 78 and the non-inverting inputs of the amplifiers 76, 76', . . . , respectively. The switches 79, 79', . . . are operated by the Q output of the D-type flip-flop 20.

The operation of the circuit of FIG. 3 is similar to that described above with respect to the circuit embodiments of FIGS. 1 and 2; however, in addition, upon initialization, for example, in response to a power-on reset event, or the like, the switches 79, 79', . . . are connected to the reference voltage. The reference voltage is applied to the non-inverting inputs of the amplifiers 76, 76', . . . to produce an initial output on node 75. The voltages on node 75 are summed by the summing amplifier 70 and applied to the phase locked loop integrator filter circuit 68. On initialization the switch 55 of the phase locked loop integrator filter circuit 68 disconnects the feedback elements, in a manner similar to that described above with reference to FIG. 2. Thus, all of the offsets of the various active elements of the phase locked loop are initialized and compensated before the digital words applied to the switches 79, 79', . . . , are applied to the input node 75 of the summing amplifier 70.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An initializing analog circuit, comprising:

an analog circuit, having a signal input, a bias input, and an output;

a switch, having a switch control input, and operative to connect the signal input of the analog circuit to a first reference potential during an initializing period and to connect the signal input of the analog circuit to an analog input responsive to receiving a switch signal at the switch control input;

a comparator connected to compare the voltage of the output of said analog circuit with a second reference potential to produce a comparator output signal representing the comparison;

a resistor ladder having a plurality of voltage step output lines along its length;

a multiplexer having a plurality of inputs, each connected to one of the voltage step output lines of said resistor ladder, having a control input, and having an output connected to the bias input of said analog circuit;

a counter having a clock input and a count output, said count output being connected to the control input of said multiplexer so that said multiplexer sequentially selects the voltage step output lines of said resistor ladder; and a control circuit, having an input coupled to the output of the comparator, having a first output coupled to the switch control input and having a second output coupled to the clock input of said counter, for clocking said counter responsive to the comparator output signal of said comparator having not yet reached a predetermined value, and for presenting the switch control signal to the switch responsive to the comparator output signal having reached the predetermined value.

2. The circuit of claim 1 wherein said control circuit comprises:

a source of clock pulses, a flip-flop connected to change states in response to the comparator output signal reaching the predetermined value, and a gate having a first input for receiving clock pulses from said source of clock pulses, having an output coupled to said counter, and having a second input connected to receive an output of said flip-flop, so that said gate inhibits said clock pulses from being applied to said counter responsive to the flip-flop changing state.

3. The circuit of claim 2 wherein said flip-flop is a D-type flip-flop.

4. The circuit of claim 2 wherein said flip-flop has a reset input for resetting its state at the beginning of the initialization period:

and wherein the output of said flip-flop is also connected to the switch control input of said switch, so that said switch connects the input of the analog circuit to the reference potential during the initializing period, and connects the input of the analog circuit to the analog input responsive to said flip-flop changing states.

5. The circuit of claim 4, further comprising a power-on-reset signal connected to reset said counter and flip-flop in response to a power on event.

6. The circuit of claim 1 wherein said first and second reference potentials are equal.

7. A circuit for initializing the output voltage of an analog circuit, comprising:

a switch operative to connect an input of the analog circuit to a first reference potential during an initializing period;

a comparator connected to compare the output voltage of said analog circuit with a second reference potential to produce an output representing the comparison;

a resistor ladder having a plurality of voltage step output lines along its length;

a multiplexer having input terminals connected to the voltage step output lines of said resistor ladder, and having an output connected to bias said analog circuit;

a counter having a clock input and a count output, said count output being connected to generate said multiplexer to sequentially select among the steps of said resistor ladder;

a clocking circuit to clock said counter until the output of said comparator reaches a predetermined value, wherein a voltage step output line of the resistor ladder is selected to control the output of said multiplexer, said clocking circuit comprising: a source of clock pulses;

a flip-flop connected to change states in response to the output of said comparator reaching the predetermined value, connected to be reset at the beginning of the initialization period, and having an output connected to operate said switch to connect the input of the analog circuit to the reference potential during the initializing period; and a gate connected to gate clock pulses from said source of clock pulses to said counter, said gate being connected to receive an output of said flip-flop to inhibit the passage of said clock pulses when the flip-flop changes state.

8. An initializing integrator circuit, comprising:

an operational amplifier, having first and second inputs and an output;

feedback elememts connected between the output and the second input of the operational amplifier, so as to provide negative feedback thereto;

a switch, having a switch control input, and operative during an initializing period to disconnect the feedback, elements from the operational amplifier;

a resistor ladder having a plurality of voltage step output lines along its length;

a multiplexer having input terminals connected to the voltage step output lines of said resistor ladder, having a control input, and having an output connected to the first input of said operational amplifier;

a counter having a clock input and a count output, said count output being connected to the control input of said multiplexer so that said multiplexer sequentially selects among the steps of said resistor ladder responsive to an advance of the count output; and a control circuit having an input coupled to the output of said operational amplifier, having a first output coupled to the switch control input, and having a second output coupled to the clock input of said counter, for clocking said counter responsive to the output of said operational amplifier not having reached a predetermined value, and for controlling said switch to connect said feedback elements to said operational amplifier responsive to the output of said operational amplifier reaching the predetermined value.

9. The circuit of claim 8 wherein said control circuit comprises:

a source of clock pulses, a flip-flop connected to change states in response to the output of said operational amplifier reaching the predetermined value, and a gate having a first input for receiving clock pulses from said source of clock pulses, having an output coupled to said counter, and having a second input connected to receive an output of said flip-flop, so that said gate inhibits said clock pulses from being applied to said counter responsive to the flip-flop changing state.

10. The circuit of claim 9 further comprising a power-on-reset signal connected to reset said counter and flip-flop in response to a power on event.

11. The circuit of claim 9 wherein said flip-flop has a reset input for resetting its state at the beginning of the initialization period;

and wherein the output of said flip-flop is also connected to the switch control input of said switch, so that said switch disconnects the feedback elements of the integrator circuit from the operational amplifier responsive to said flip-flop resetting its state, and connects the feedback elements to the operational amplifier responsive to said flip-flop changing states.

12. The circuit of claim 11, wherein said flip-flop is a D-type flip-flop.

13. A circuit for initializing the output voltage of an integrator circuit having an operational amplifier and feedback elements connected between an output and an inverting input of the operational amplifier, comprising:

a switch operative during an initializing period to disconnect the feedback elements of the integrator circuit;

a resistor ladder having a plurality of voltage step output lines along its length;

a multiplexer having input terminals connected to the voltage step output lines of said resistor ladder, and having an output connected to a non-converting input of said operational amplifier;

a counter having a clock input and a count output, said count output being connected to operate said multiplexer to sequentially select along the steps of said resistor ladder; and a clocking circuit to clock said counter until the output of said operational amplifier reaches a predetermined value, wherein a voltage step output line is selected to control the output of said multiplexer said clocking circuit comprising:.

a source of clock pulses;

a flip-flop connected to change states in response to the output of said operational amplifier reaching the predetermined value, connected to be reset at the beginning of the initialization period, and having an output connected to operate said switch to disconnect the feedback elements of the integrated circuit; and a gate connected to gate clock pulses from said source of clock pulses to said counter, said gate being connected to receive an output of said flip-flop to inhibit the passage of said pulses when the flip-flop changes state.

14. An initializing phase locked loop circuit, comprising:

a phase locked loop, of the type having:

a plurality of input nodes, each for receiving signals to be summed, a summing amplifier having a first input coupled to said plurality of input nodes, having a second input, and having an output, an operational amplifier having a first input connected to a first reference potential, a second input, add an output, and feedback elements connected between the output and the second input of the operational amplifier to provide negative feedback thereto;

a first switch, having a control input, and operative during an initializing period to disconnect the feedback elements from the integrator circuit;

a plurality of second switches, each having a control input, and each operative during the initializing period to connect each of the plurality of input nodes to a second reference potential;

a resistor ladder having a plurality of voltage step output lines along its length;

a multiplexer having input terminals connected to the voltage step output lines of said resistor ladder, having a control input, and having an output connected to the second input of said summing amplifier to provide a bias reference thereto;

a counter having a clock input and a count output, said count output being connected to the control input of said multiplexer so that said multiplexer sequentially selects, among the steps of said resistor ladder responsive to an advance of the count output;

a control circuit having an input coupled to the output of said operational amplifier, having a first output coupled to the control inputs of said first switch and of said plurality of second switches, and having a second output coupled to the clock input of said counter, for clocking said counter responsive to the output of said operational amplifier not having reached a predetermined value, and for, responsive to the output of said operational amplifier reaching the predetermined value, controlling said first switch to connect said feedback elements to said operational amplifier and controlling said plurality of second switches to connect said input nodes to receive input signals.

15. The circuit of claim 14, wherein said control circuit comprises:

a source of clock pulses, a flip-flop connected to change states in response to the output of said operational amplifier reaching the predetermined value, and a gate having a first input for receiving clock pulses from said source of clock pulses, having an output coupled to said counter, and having a second input connected to receive an output of said flip-flop, so that said gate inhibits said clock pulses from being applied to said counter responsive to the flip-flop changing state.

16. The circuit of claim 15 further comprising a power-on-reset signal connected to reset said counter and flip-flop in response to a power on event.

17. The circuit of claim 14 wherein said first and second reference potentials are equal.

18. The circuit of claim 15 wherein said flip-flop has a reset input for resetting its state at the beginning of the initialization period:

and wherein the output of said flip-flop is also connected to the switch control input of said first switch and said second switches, so that said first switch disconnects the feedback elements of the integrator circuit from the operational amplifier responsive to said flip-flop resetting its state and connects the feedback elements to the operational amplifier responsive to said flip-flop changing states, and so that said second switches connect the input nodes to the second reference voltage responsive to said flip-flop resetting its state and connects the input nodes to receive input signals responsive to said flip-flop changing states.

19. The circuit of claim 18, wherein said flip-flop is a D-type flip-flop.

20. A circuit for initializing the output voltage of a phase locked loop of the type having a) a plurality of input nodes each for receiving signals to be summed, b) a summing amplifier connected to receive the signals received by said plurality of input nodes, and c) an integrator circuit having an operational amplifier and feedback elements connected between an output and an inverting input, a non-inverting input being connected to a first reference potential, comprising:

a first switch operative during an initializing period to disconnect the feedback elements of the integrator circuit;

a plurality of second switches each operative during the initializing period to connect the input nodes to a second reference potential;

a resistor ladder having a plurality of voltage step output liens along its length a multiplexer having input terminals connected to the voltage step output lines of said resistor ladder, and having an output connected to a non-inverting input of said summing amplifier to provide a bias reference thereto;

a counter having a clock input and a count output, said count output being connected to operate said multiplexer to sequentially select among the steps of said resistor ladder;

a clocking circuit to clock said counter until the output of said operational amplifier of said integrator circuit reaches a predetermined value, wherein a voltage step output line is selected to control the output of said multiplexer, said clocking circuit comprising:

a source of clock pulses;

a flip-flop connected to change states in response to the output of said operational amplifier, connected to be reset at the beginning of the initialization period, and having an output connected to operate said first switch and said second switches; and a gate connected to gate clock pulses from said source of clock pulses to said counter, said gate being connected to receive an output of said flip-flop to inhibit the passage of said clock pulses when the flip-flop changes state.

* * * * *